US005839842A

United States Patent [19]

Wanat et al.

[11] Patent Number: 5,839,842

[45] Date of Patent: Nov. 24, 1998

[54] CLEANSING SYSTEM INCLUDING A TOILET BAR AND SPONGE SUPPORTED WITHIN A POROUS POUCH

[75] Inventors: Jill Dene Wanat, New York, N.Y.; Howard Bruce Kaiserman, Haworth, N.J.

[73] Assignee: Lever Brothers Company, Division of Conopco, Inc., New York, N.Y.

[21] Appl. No.: 25,179

[22] Filed: Feb. 17, 1998

Related U.S. Application Data

[60] Provisional application No. 60/073,815 Feb. 5, 1998.

[51] Int. Cl.[6] ..... A47K 7/02

[52] U.S. Cl. ..... 401/201; 206/77.1; 434/262

[58] Field of Search ..... 401/200, 201; 206/77.1; 383/117; 434/262, 433; 15/1, 244.1, 244.4, 227

[56] References Cited

U.S. PATENT DOCUMENTS

| | | | |
|---|---|---|---|
| 1,682,119 | 8/1928 | Field . | |
| 2,607,940 | 8/1952 | Miller . | |
| 2,958,885 | 11/1960 | Donney | 401/201 |
| 3,167,805 | 2/1965 | Zuppinger et al. . | |
| 3,483,907 | 12/1969 | Corridon | 383/117 |
| 4,457,643 | 7/1984 | Caniglia | 401/201 |
| 4,480,939 | 11/1984 | Upton . | |
| 4,953,250 | 9/1990 | Brown | 401/201 |
| 5,031,759 | 7/1991 | Ogilvie | 401/201 |
| 5,092,682 | 3/1992 | Fenick | 383/117 |
| 5,238,305 | 8/1993 | Feller | 383/117 |
| 5,366,125 | 11/1994 | Procido | 383/117 |
| 5,609,431 | 3/1997 | Carroll | 401/201 |

*Primary Examiner*—Charles R. Eloshway

*Attorney, Agent, or Firm*—Milton L. Honig

[57] ABSTRACT

A cleansing kit is provided which includes a pouch of netted mesh, a closed cell sponge and a toilet bar. Preferably the sponge is sculpted in the form of a mitt or cartoon character.

8 Claims, 1 Drawing Sheet

FIG.
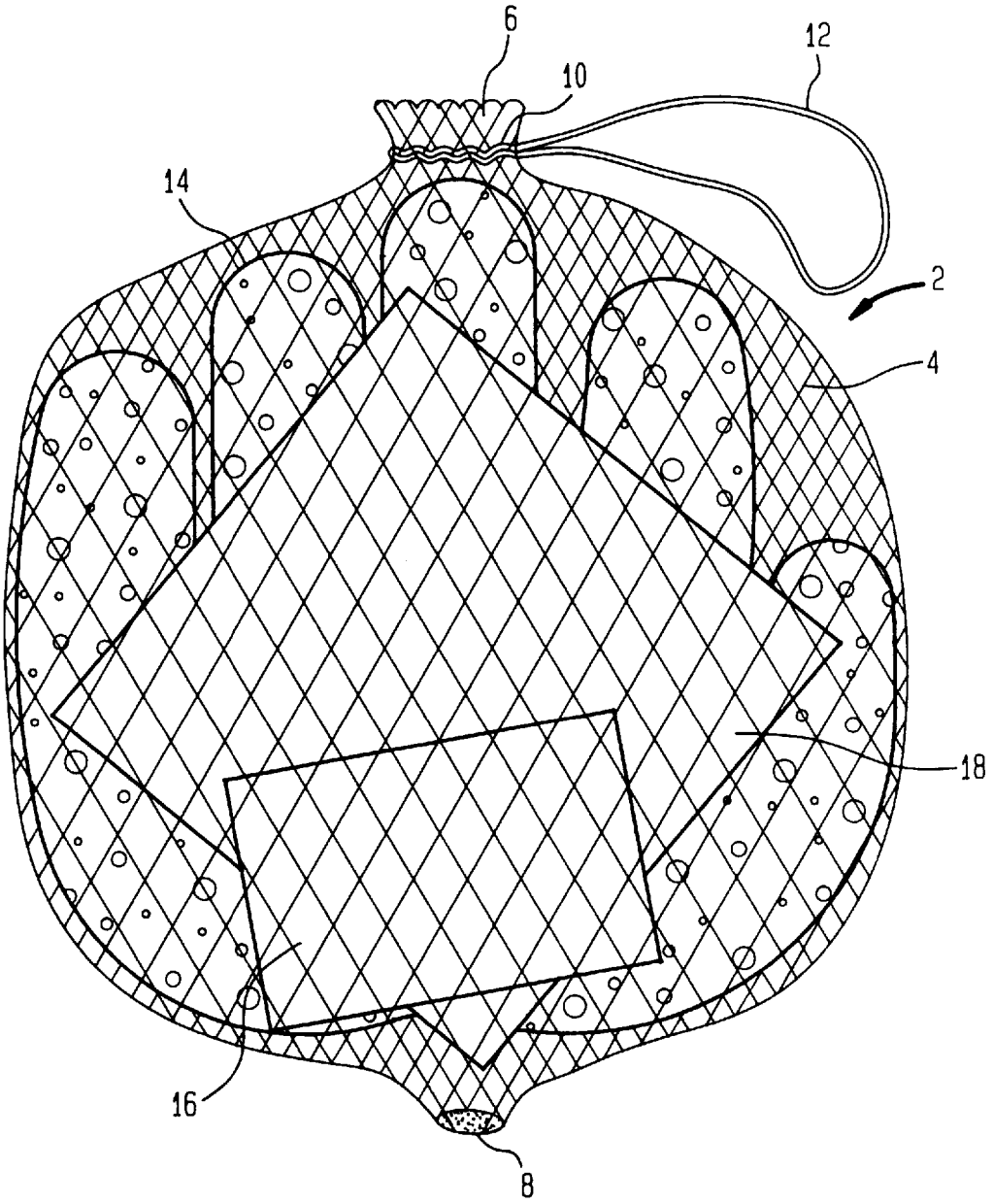

CLEANSING SYSTEM INCLUDING A TOILET BAR AND SPONGE SUPPORTED WITHIN A POROUS POUCH

This application claims priority through a Provisional Application Ser. No. 60/073,815 filed Feb. 5, 1998 under 35 U.S.C. § 119(e).

BACKGROUND OF THE INVENTION

1. Field of the Invention

The invention concerns a personal cleansing system or kit wherein a toilet bar and sponge are held within confines of a porous pouch.

2. The Related Art

Toilet bars are highly popular cleansing products. In many countries toilet bars have been sold packaged within a diamond mesh draw-string controlled netted pouch. There have been suggestions to employ the pouch as a cleansing implement in conjunction with the lather producing bar.

One of the earliest disclosures is U.S. Pat. No. 1,682,119 (Field) wherein a metallic fabric wrapper or bag of sufficiently fine mesh is provided with soap in flake or fragment form. U.S. Pat. No. 2,607,940 (Miller) reports a bag of open mesh material so constructed as to permit easy insertion of soap while preventing its accidental escape from the bag. Similar concepts with pouch holding mechanisms are reported in U.S. Pat. No. 3,167,805 (Zuppinger et al.) and U.S. Pat. No. 4,480,939 (Upton).

None of the prior art is particularly attractive to children while also affording a modicum of antibacterial hygiene. Furthermore, the open celled meshed bags when employed as a lathering device have certain shortcomings. These are not as resilient as closed cell foamed sponges, are difficult to form into child attracting shapes and lack the ergonomic excitement of squeezability.

Accordingly, it is an object of the present invention to provide a cleansing kit which is attractive to children yet also provides for good hygiene.

Another object of the present invention is to provide a cleansing kit holding a toilet bar and a combination of two implements one of which improves foaming and the other maintains the ergonomic benefits of squeezability and solidity.

These and other objects of the present invention will more fully be described in the accompanying summary and detailed description.

SUMMARY OF THE INVENTION

A cleansing kit is provided which includes:

(i) a closable pouch formed of an open cell material;

(ii) a closed cell sponge held within the pouch; and (iii) a toilet bar supported within the pouch.

Furthermore, a method is provided for cleansing a human body which includes applying to the body the aforementioned kit in the presence of water, generating foam from interaction of the kit with water and then lathering the body with the kit and resultant foam. After the cleansing experience, hygiene of the kit to discourage microbial growth is practiced by hanging the pouch with its sponge and toilet bar contents for drying.

BRIEF DESCRIPTION OF THE DRAWING

Additional objects, features and advantages of the present invention will more fully be appreciated through the following drawing consisting of a sole FIGURE illustrating a diamond net pouch holding a toilet bar and a sponge sculpted in the shape of a hand.

DETAILED DESCRIPTION OF THE INVENTION

Now it has been discovered that the objects of the present invention are achieved by a kit which includes an open cell mesh bag holding a closed cell sponge and a toilet bar.

The FIGURE illustrates various elements of the cleansing kit. A pouch 2 is formed of a diamond shaped mesh net 4 having a pocket with an open and a closed end 6, 8. A drawstring 10 is looped around open end 6 with a portion of its length being capable of serving as a suspension hook 12. After use, the kit can be hung to dry by attachment of hook 12 from a shower fixture or similar support. The pouch carries a closed cell sponge 14 in the shape of a hand or mitt. A toilet bar 16 of appropriate size is also supported within pouch 2. An instruction sheet 18 is included within the pouch 4 to provide guidance on use of the kit.

The pouch is generally formed of a light weight polymeric meshed substrate. The material most generally is an extruded tubular netting mesh, particularly prepared from polyolefins such as polyethylene. Of course other materials of construction may be employed besides polyolefins. These may be polyamides or polyesters. They may be single or multiple ply netting. Mesh structure may be polygonal, especially diamond shaped, but need not necessarily be so. Also suitable are irregular shapes. Of course, the main characteristic of the pouch material must be that the cells are open and, preferably, that contents within the pouch can be observable from the exterior.

The sponge within the pouch is a closed cell material either of synthetic or natural origin. Synthetic sponges are generally formed of foamed polyurethane. The primary embodiment of the present invention employs a sculpted closed cell sponge formed in the shape of a hand or mitt. By the term "sculpted" is meant a non-regular shaped object other than round, spherical, square, rectangular or regular polygonal. Also contemplated for this invention are sculpted cartoon caricatures. Suitable examples are Disney® characters (e.g. Simba® (Lion), Mickey Mouse® and Donald Duck®), Sesame Street® muppets, action heros (e.g. Superman®), Batman® or the like) and newspaper cartoon characters as well as unknown caricatures.

Toilet bars used for the present invention are solid or semi-solid substances including a surfactant system and optionally structuring aids, fillers, preservative and other minor ingredients. These components may be as follows.

Surfactant System

Anionic, nonionic, cationic, amphoteric, zwitterionic and surfactant active mixtures are suitable for the present invention. The anionic active may be selected from aliphatic sulfonates, such as a primary alkane (e.g., $C_8$–$C_{22}$) sulfonate, primary alkane (e.g., $C_8$–$C_{22}$) disulfonate, $C_8$–$C_{22}$ alkene sultonate, $C_8$–$C_{22}$ hydroxyalkane sulfonate or alkyl glyceryl ether sulfonate (AGS); or aromatic sulfonates such as alkyl benzene sulfonate.

The anionic may also be an alkyl sulfate (e.g., $C_{12}$–$C_{18}$ alkyl sulfate) or alkyl ether sulfate (including alkyl glyceryl ether sulfates). Among the alkyl ether sulfates are those having the formula:

$RO(CH_2CH_2O)nSO_3M$ wherein R is an alkyl or alkenyl having 8 to 18 carbons, preferably 12 to 18 carbons, n has an average value of greater than 1.0, preferably greater than 3; and M is a solubilizing cation such as sodium, potassium, ammonium or substituted ammonium. Ammonium and sodium lauryl ether sulfates are preferred.

The anionic may also be selected from alkyl sulfosuccinates (including mono- and dialkyl, e.g., $C_6$–$C_{22}$ sulfosuccinates); alkyl and acyl taurates, alkyl and acyl sarcosinates, $C_8$–$C_{22}$ alkyl phosphates, alkyl phosphate esters and alkoxyl alkyl phosphate esters, acyl lactates, $C_8$–$C_{22}$ monoalkyl succinates and maleates, sulphoacetates, and acyl isethionates.

Particularly preferred are the $C_8$–$C_{18}$ acyl isethionates. These esters are prepared by reaction between alkali metal isethionate with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms.

Acyl isethionates, when present, will generally range from about 10% to about 70% by weight of the total bar composition. Preferably, this component is present from about 30% to about 60%.

The bar may comprise a certain amount of soap as anionic surfactant. The term "soap" is used in its popular sense, i.e., alkalimetal or alkanol ammonium salt of aliphatic alkane or alkene monocarboxylic acids. Sodium, potassium, mono-, di- and triethanol ammonium cations, or combinations thereof, are suitable for purposes of the invention. Generally, sodium soaps are used. Soaps useful herein are the well known alkali metal salts of natural or synthetic aliphatic (alkanoic or alkenoic) acids having 13 to 22 cations, preferably 12 to 18.

Amphoteric surfactants which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. Examples include cocoamidopropyl betaine and sulphobetaine.

Nonionics actives which may be used include in particular the reaction products of compounds having a hydrophobic group and a reactive hydrogen atom, for example aliphatic alcohols, acids, amides or alkylphenols with alkylene oxides, especially ethylene oxide either alone or with propylene oxide. Specific nonionic detergent compounds are alkyl ($C_6$–$C_{22}$) phenol ethylene oxide condensates, the condensation products of aliphatic ($C_8$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides, dialkyl sulphoxides, alkyl polyglucosides and methyl glucamides.

Examples of cationic detergents are the quaternary ammonium compounds such as alkyldimethylammonium halogenides.

Other surfactants which may be used are described in U.S. Pat. No. 3,723,325 to Parran Jr. and "Surface Active Agents and Detergents"(Vol. I & II) by Schwartz, Perry & Berch, both of which are incorporated into the subject application by reference.

One preferable surfactant system comprises:

(a) a first synthetic surfactant which is anionic; and (b) a second synthetic surfactant selected from the group consisting of a second anionic different from the first, a nonionic, an amphoteric and mixtures thereof.

Structuring Aids and/or Fillers

The compositions may also contain 10 to 90% by wt., preferably 20 to 80% by wt. of a structurant and/or filler. Such structurants can be used to enhance the bar integrity, improve the processing properties, and enhance desired user sensory profiles.

The structurant is generally long chain, preferably straight and saturated, ($C_8$–$C_{24}$) fatty acid or ester derivative thereof; and/or branched long chain, preferably straight and saturated, ($C_8$–$C_{24}$) alcohol or ether derivatives thereof.

A preferred bar structurant is polyalkylene glycol with molecular weight between 2000 and 20,000, preferably between 3000 and 10,000. Other ingredients that can be used as structurants or fillers include starches, preferably water soluble starches such as maltodextrin and polyethylene wax or paraffin wax.

Other structuring aids which may be used include Amerchol Polymer HM 1500 (Nonoxynyl Hydroethyl Cellulose).

Optional ingredients

The toilet bar compositions of the invention may include 0 to 15% by wt. optional ingredients as follows: perfumes; sequestering agents, such as tetrasodium ethylenediaminetetraacetate (EDTA), EHDP or mixtures in an amount of 0.01 to 1%, preferably 0.01 to 0.05%; and coloring agents, opacifiers and pearlizers such as zinc stearate, magnesium stearate, $TiO_2$, EGMS (ethylene glycol monostearate) or Lytron 621 (Styrene/Acrylate copolymer); all of which are useful in enhancing the appearance or cosmetic properties of the product.

The compositions may further comprise antimicrobials such as 2-hydroxy-4,2',4'-trichlorodiphenylether (DP300); preservatives such as dimethyloldimethylhydantoin (Glydant XL1000), parabens, sorbic acid etc.

The compositions may also comprise coconut acyl mono- or diethanol amides as suds boosters, and strongly ionizing salts such as sodium chloride and sodium sulfate may also be used to advantage.

Antioxidants such as, for example, butylated hydroxytoluene (BHT) may be used advantageously in amounts of about 0.01% or higher if appropriate.

Cationic polymers as conditioners which may be used include Quatrisoft LM-200, Polyquaternium-24, Merquat Plus 3330 - Polyquaternium 39 and Jaguar® type conditioners.

The foregoing description and examples illustrate selected embodiments of the present invention. In light thereof variations and modifications will be suggested to one skilled in the art, all of which are within the spirit and purview of this invention.

What is claimed is:

1. A cleansing kit for children to practice good hygiene comprising:

(i) a closable pouch formed of an open cell material;

(ii) a closed cell sponge held within the pouch;

(iii) a toilet bar supported within the pouch; and (iv) a sheet of instructions on use of components of the kit.

2. The kit according to claim 1 wherein the pouch is formed of a diamond netted mesh material.

3. The kit according to claim 2 wherein the material is polyethylene.

4. The kit according to claim 1 wherein the sponge is a polyurethane substance.

5. The kit according to claim 1 wherein the toilet bar is formed from a surfactant selected from the group consisting of salts of acyl isethionate, alkyl glyceryl ether sulfonate, alkyl or acyl sarcosinate, stearate, alkyl ether sulfonate, alkyl sulfate, cocoamidopropylbetaine and mixtures thereof.

6. The kit according to claim 1 wherein the pouch further comprises a drawstring across an open mouth of the pouch.

7. The kit according to claim 1 wherein the closed cell sponge is formed in a shape of a hand or mitt.

8. The kit according to claim 1 wherein the closed cell sponge is sculpted as a cartoon caricature.

* * * * *